US008723748B2

(12) United States Patent
Svensson

(10) Patent No.: US 8,723,748 B2
(45) Date of Patent: May 13, 2014

(54) DUAL FREQUENCY ANTENNA APERTURE

(75) Inventor: Bengt Svensson, Mölndal (SE)

(73) Assignee: Saab AB, Linköping (SE)

( * ) Notice: Subject to any disclaimer, the term of this patent is extended or adjusted under 35 U.S.C. 154(b) by 409 days.

(21) Appl. No.: 13/141,427

(22) PCT Filed: Dec. 22, 2008

(86) PCT No.: PCT/SE2008/051553

§ 371 (c)(1),
(2), (4) Date: Sep. 12, 2011

(87) PCT Pub. No.: WO2010/074618

PCT Pub. Date: Jul. 1, 2010

(65) Prior Publication Data

US 2011/0316734 A1 Dec. 29, 2011

(51) Int. Cl.
*H01Q 13/00* (2006.01)

(52) U.S. Cl.
USPC ..... 343/770; 343/700 MS; 343/771

(58) Field of Classification Search
USPC ..... 343/700 MS, 767, 770, 771, 795, 798
See application file for complete search history.

(56) References Cited

U.S. PATENT DOCUMENTS

| | | | | |
|---|---|---|---|---|
| 3,969,730 | A * | 7/1976 | Fuchser | 343/770 |
| 4,477,813 | A * | 10/1984 | Weiss | 343/700 MS |
| 5,153,600 | A | 10/1992 | Metzler et al. | |
| 5,262,791 | A | 11/1993 | Tsuda et al. | |
| 5,726,666 | A * | 3/1998 | Hoover et al. | 343/770 |
| 5,872,545 | A * | 2/1999 | Rammos | 343/770 |
| 6,028,562 | A * | 2/2000 | Guler et al. | 343/771 |
| 6,121,931 | A | 9/2000 | Levi | |
| 6,285,335 | B1 * | 9/2001 | Snygg et al. | 343/770 |
| 6,741,210 | B2 | 5/2004 | Brachat et al. | |
| 7,589,676 | B2 * | 9/2009 | Popugaev et al. | 343/700 MS |
| 8,558,746 | B2 * | 10/2013 | Thomson et al. | 343/776 |

FOREIGN PATENT DOCUMENTS

| | | | |
|---|---|---|---|
| FR | 2734411 | A1 | 11/1996 |
| WO | WO-0135491 | A1 | 5/2001 |

OTHER PUBLICATIONS

PCT/ISA/210—International Search Report—Sep. 3, 2009.
PCT/ISA/237—Written Opinion of the International Searching Authority—Sep. 3, 2009.

* cited by examiner

*Primary Examiner* — Tho G Phan
(74) *Attorney, Agent, or Firm* — Venable LLP; Eric J. Franklin

(57) ABSTRACT

An antenna structure including at least two stacked antenna apertures, a first antenna aperture with first antenna elements and at least a second antenna aperture with second antenna elements. The antenna structure is arranged for operation in at least a high and a low frequency band. The first antenna elements are arranged for operation in the high frequency band and the second antenna elements for operation in the low frequency band. The first antenna elements are arranged to have a polarization substantially perpendicular to the polarization of the second antenna elements. The second antenna elements are arranged in at least one group and each of the group includes a number of second antenna elements coupled in series and arranged to have a common feeding point on a straight feeding structure. One feeding structure is located adjacent to each group of second antenna elements. The direction of the feeding structure is substantially perpendicular to the polarization of the first antenna elements. A corresponding method and a radar system including the antenna structure.

25 Claims, 4 Drawing Sheets

DUAL FREQUENCY ANTENNA APERTURE

CROSS-REFERENCE TO RELATED APPLICATIONS

This application is the national phase under 35 U.S.C. §371 of PCT/SE2008/051553 filed 22 Dec. 2008.

TECHNICAL FIELD

The present invention relates to the field of antennas for radio communication and radar systems.

BACKGROUND ART

A surveillance radar system comprises a Primary Surveillance Radar (PSR) and an Identification Friend or Foe/Secondary Surveillance Radar (IFF/SSR). In prior art solutions, the IFF/SSR-antenna system typically consists of one or more separate antennas.

In a radar surveillance system, the PSR antenna will have a very narrow, main beam and extremely low side lobes. The IFF/SSR antenna has an operating frequency which normally is a few times lower than the operating frequency of the PSR. It is normally desired to have as large aperture as possible, measured in wavelengths, for both functions. One standard solution is to have two separate antenna apertures, which means an overall antenna system size, being the sum of the two antenna apertures. It would be desirable to use an increased aperture for the IFF/SSR-antenna without substantially increasing the overall antenna system size for a combined PSR and IFF/SSR antenna structure and without substantially degrading the PSR antenna performance. The arrays of the PSR and the IFF/SSR antennas may be electronically scanned which means that the direction of a main lobe can be electronically controlled. The PSR typically operates in a frequency band around one to several GHz.

U.S. Pat. No. 6,121,931 discloses a solution with a dual frequency array antenna having an essentially planar structure with electronic beam steering capability in both a low and a high frequency band independently of each other. The antenna is arranged in a layered formation, with a top planar array antenna unit operating in a low frequency band and a bottom planar array antenna unit operating in the high frequency band. The top planar array antenna is transparent to frequencies in the high frequency band. A drawback with this solution is that a rather complicated frequency selective surface for the radiating elements and ground plane of the top planar array antenna is required. A further drawback is that each antenna element in the top planar array antenna requires an individual feed, resulting in a complicated feeding network interfering with the bottom planar array antenna. The solution also has the limitation of using only patch elements in both bottom and top planar array antenna. The problem of achieving isolation between the two array antennas is solved by using frequency selective surfaces for the top planar array antenna. In order for such frequency selective surfaces to work as intended, they normally need to be very large, ideally infinite. In practice, the limited size will cause edge effects that will degrade the performance. This is a fairly complicated solution resulting in disturbances between the top and bottom planar array antennas degrading the high frequency performance.

FR 2734411, considered as closest prior art shows a solution where dipoles are interlaced with slots. The invention however seems to solve the problem to work with two different polarizations and not with two different frequency bands.

The slots and dipoles are located in the same plane which creates a risk for interference between the two types of antenna elements. The feeding of the dipoles is complicated and/or includes parts of the feeding structure being parallel or almost parallel to the polarization of the slots. This feeding structure also increases the risk of increased interference between the different types of antenna elements. Furthermore, the substrate, used as a carrier for the microstrip transmission lines, will add losses to the slot antenna since it is located very close to the slot apertures.

There is thus a need to achieve an increased aperture for a low frequency antenna, as the IFF/SSR-antenna, without substantially degrading the PSR antenna performance and without substantially increasing the overall antenna system size for a combined high frequency, as the PSR antenna, and low frequency antenna structure while at the same time have an improved feeding of the antenna functions, and improved isolation between the antenna functions.

SUMMARY OF THE INVENTION

The object of the invention is to reduce at least some of the above mentioned deficiencies with prior art solutions and to provide:

an antenna structure, and a method to solve the problem to achieve an increased aperture for a low frequency antenna, as the IFF/SSR-antenna, without degrading the PSR antenna performance and without substantially increasing the overall antenna system size for a combined high frequency, as the PSR antenna, and low frequency antenna structure while at the same time have an improved feeding of the antenna functions, and improved isolation between the antenna functions.

This object is achieved by providing an antenna structure comprising at least two stacked antenna apertures, a first antenna aperture with first antenna elements and at least a second antenna aperture with second antenna elements wherein the antenna structure is arranged for operation in at least a high and a low frequency band. The first antenna elements are arranged for operation in the high frequency band and said second antenna elements for operation in the low frequency band. The first antenna elements are arranged to have a polarization substantially perpendicular to the polarization of the second antenna elements. The second antenna elements are arranged in at least one group and each of said group, comprises a number of second antenna elements coupled in series and arranged to have a common feeding point on a straight feeding structure. One feeding structure is located adjacent to each group of second antenna elements. The direction of the feeding structure is substantially perpendicular to the polarization of the first antenna elements.

The object is further achieved by providing a method for arranging an antenna structure comprising at least two stacked antenna apertures, a first antenna aperture with first antenna elements and at least a second antenna aperture with second antenna elements wherein the antenna structure is arranged for operation in at least a high and a low frequency band. The first antenna elements are arranged for operation in the high frequency band and said second antenna elements for operation in the low frequency band. The first antenna elements have a polarization substantially perpendicular to the polarization of the second antenna elements and the second antenna elements are arranged in at least one group. Each of said group, comprises a number of second antenna elements coupled in series, having a common feeding point on a straight feeding structure. One feeding structure is located adjacent to each group of second antenna elements. The direction of the feeding structure is substantially perpendicular to the polarization of the first antenna elements.

The invention also includes a radar system including an antenna structure.

DETAILED DESCRIPTION

The invention will now be described in detail with reference to the drawings.

The invention is applicable in general to antennas for radio communication or radar system requiring two antenna apertures working at different frequency bands. Henceforth in the description the invention is exemplified with a radar system requiring one antenna aperture for a PSR antenna operating at a certain high frequency and one antenna aperture for an IFF/SSR antenna operating at a certain lower frequency. Other combinations of one high and one low frequency band are possible within the scope of the invention. A typical application can be a high frequency of one to several GHz, the high frequency being 3-4 times higher than the low frequency. In this example certain directions of slots, columns and polarizations are defined as vertical and horizontal. The invention is however applicable to other directions as long the two directions are substantially perpendicular.

When a certain aperture is defined to be located in front of or above an other aperture, this certain aperture is henceforth meant to be positioned further along a mean boresight beam direction of the antenna structure in transmit mode than the other aperture, i.e. closer to the far field of the radiation patterns of the antenna structure, where each antenna aperture has its own radiation pattern. A boresight beam direction is a direction perpendicular to an antenna aperture. When the antenna apertures are substantially parallel, the boresight beam directions are the same for each antenna aperture. When the apertures are not in parallel, they have different boresight beam directions and the mean boresight beam direction is here defined as a direction halfway between the two boresight beam directions having the biggest difference in boresight beam direction.

Figure 1:
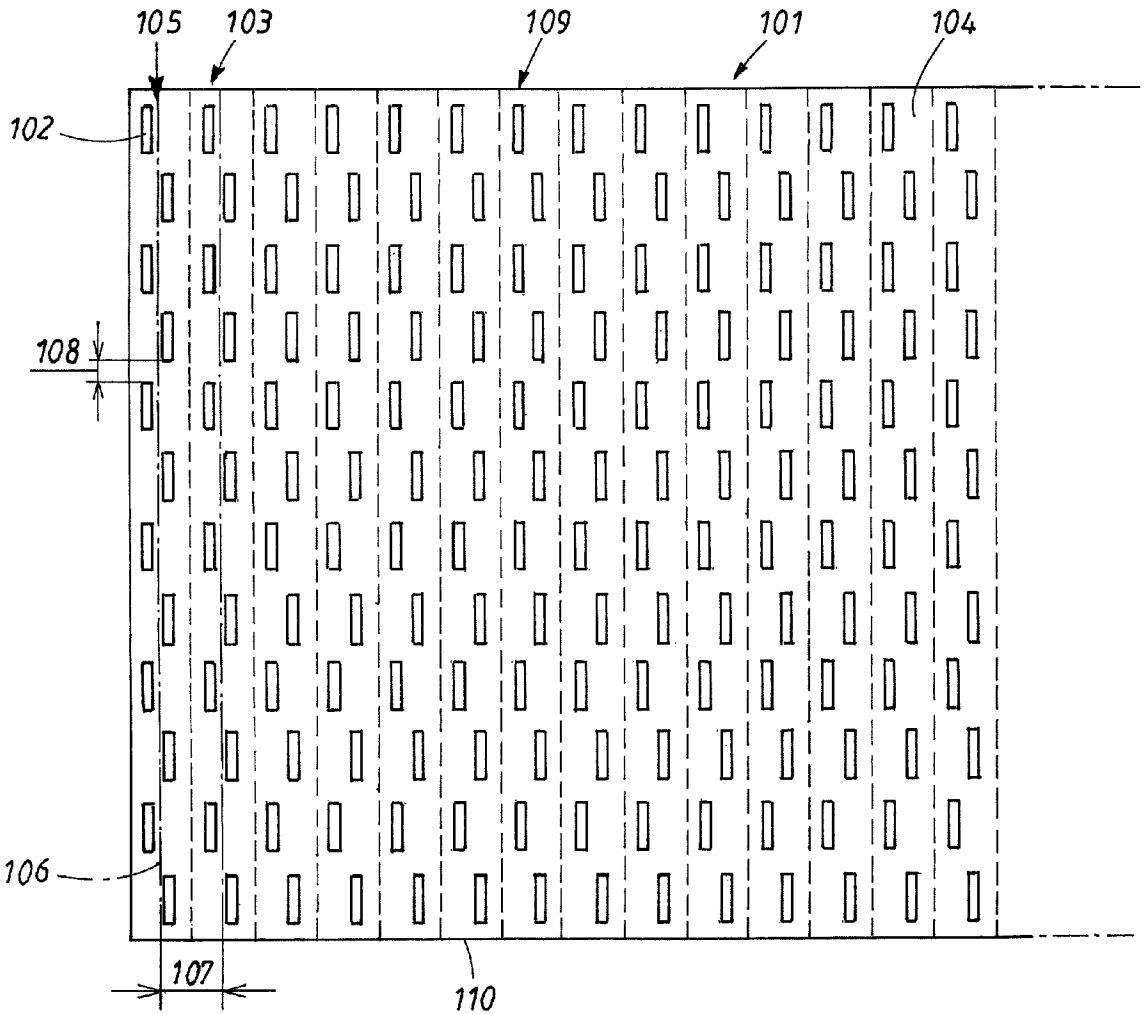
FIG. 1 schematically shows one example of a top view of a PSR antenna aperture.

This example of a PSR antenna consists of a number of vertically oriented waveguides with a number of shunt slots oriented along the extension of the waveguide as shown in FIG. 1. The PSR antenna can however be realized with other antenna elements e.g. with dipole elements or open-ended waveguides. FIG. 1 shows a first antenna aperture 101 with first antenna elements 102 and waveguides 103. In the example, illustrating the invention, the first antenna elements are vertical slots in a conductive surface 104. A vertical slot has, as is well known to the skilled person a horizontal polarization. The vertical slots are arranged in a regular lattice and located in vertical columns 105 of first antenna elements along a vertical centre line 106 of each waveguide. Every second slot is off-centred to one side of the centre line 106 and the slots in between are off-centred to the opposite side of the centre line. There is a substantially constant first distance 107 between the centre lines of adjacent waveguides and a substantially constant second distance 108 between neighbouring slots in a column. The first antenna aperture has a first edge 109 and a second edge 110, the edges being part of the perimeter of the first antenna aperture. The first edge is limiting the longitudinal extension of the columns 105 of the first antenna elements in one direction and the second edge is limiting the longitudinal extension of the columns 105 of the first antenna elements in the opposite direction. The shape of the first antenna aperture is rectangular in the example of FIG. 1, but any other shapes are possible within the scope of the invention. The shape can e.g. be adapted to fit a shape of a radome covering the first antenna aperture. The amount of off-centring of the slots and the length of the slots can be slightly varied from slot to slot to achieve a tapering effect implying that the current distribution on the antenna aperture will be concentrated more to the central parts of the aperture. This tapering will result in lowering the side lobe level in the elevation plane.

The wave guides are fed in any conventional way, well known to the skilled person. Typically the feeding can be realized with an adapter between the waveguide and some other type of transmission line, e.g. microstrip- or stripline.

In order for the main beam of the first antenna aperture to be electronically scannable the first distance 107 between centre-lines need to be typically around half a wavelength or less of a centre frequency in the frequency band of the first antenna aperture. This also means that the first distance 107 can be somewhat above half a wavelength depending on the antenna scan requirements. For the PSR antenna this typically corresponds to a first distance of a few cm. If the distance becomes larger, undesired grating lobes will start to appear when the beam is electronically scanned off boresight. Boresight is a direction perpendicular to the antenna aperture. The invention is however applicable also to non-scannable antennas, which mean that the first distance 107 can be above half a wavelength, typically around one wavelength.

An important aspect of the invention is to place a "transparent" IFF/SSR-antenna within substantially the same area as the PSR antenna and thus integrate two antenna apertures within substantially the same physical geometry. In one embodiment the IFF/SSR-antenna is placed in front of or above the PSR antenna. This is possible to do if the two antenna functions are separated in frequency and/or polarisation which can be accomplished by using vertical dipoles for the IFF/SSR-antenna and vertical slots for the PSR antenna. However this is only one possible application of the invention. In general the invention is applicable to the integration of a high frequency antenna aperture, the first antenna aperture, with a low frequency antenna aperture, the second antenna aperture, by stacking the two antenna apertures. It is also possible to have more than two antenna apertures as will be explained in association with FIG. 4.

Henceforth in the description the invention will, unless otherwise stated, be explained with an example where the IFF/SSR-antenna is placed in front of or above the PSR antenna, i.e. the low frequency antenna aperture is transparent for the high frequency antenna aperture and the high frequency antenna aperture is "radiating through" the low frequency antenna aperture. However also the opposite situation is possible within the scope of the invention, i.e. the high frequency antenna aperture is transparent for the low frequency antenna aperture and the low frequency antenna aperture is "radiating through" the high frequency antenna aperture.

In the example illustrating the invention the first antenna aperture is a PSR antenna with first antenna elements realized as vertical slots in vertical waveguides. The waveguides are arranged side-by-side as shown in FIG. 1. The slots are horizontally polarized.

Figure 2:
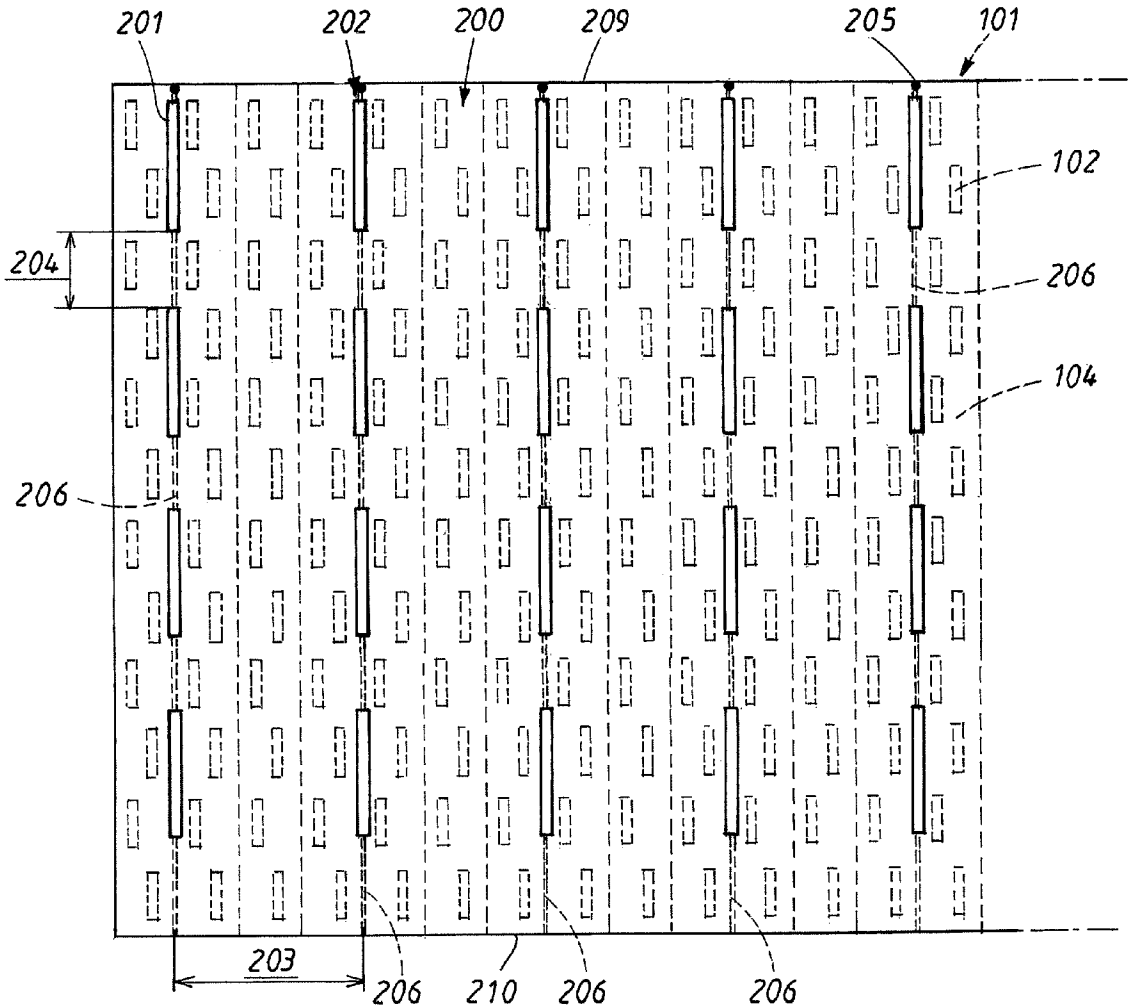
FIG. 2 schematically shows one example of a top view of an IFF/SSR antenna on top of a PSR antenna according to one embodiment of the invention.

The second antenna aperture is an IFF/SSR antenna with second antenna elements consisting of vertical dipoles, see FIG. 2. Vertical dipoles have, as is well known to the skilled person a vertical polarization. Since the polarization of the dipoles is perpendicular to the PSR antenna polarization, the disturbance will be reasonably small.

The length of the dipoles will roughly be three to four times the slot length as the wavelength at this IFF/SSR-frequency is about three to four times that of the wavelength at the PSR frequency. One problem with this solution is that the dipoles may have to be fed through the slot antenna plate, especially if a number of dipoles stacked above or in front of each other are desired. The invention however solves this problem with a feeding arrangement that will be explained in association with FIG. 3.

In an embodiment of the invention an array of series fed, vertical columns of second antenna elements, are positioned in front of the PSR antenna comprising a slotted waveguide aperture or other horizontally polarised first antenna aperture, as shown in FIG. 2. In an alternative solution the first antenna aperture can be vertically polarized, e.g. by using horizontal slots and the second antenna aperture horizontally polarized e.g. by using horizontal dipoles. The direction of polarization of the two antenna apertures is arbitrary as long as the two polarizations are substantially perpendicular to each other. The second antenna elements of the second antenna aperture does not necessarily have to be dipoles but can be other antenna elements as e.g. elongated patches. An important feature of the invention is that the polarization of the first and the second antenna elements is substantially perpendicular.

FIG. 2 shows with dotted lines the first antenna aperture 101, with the vertical slots 102 and the conductive surface 104 covered with the second antenna aperture 200 comprising second antenna elements 201 in this example comprising of the vertical dipoles. The antenna structure thus comprises two stacked antenna apertures. The dipoles are arranged in at least one group and in one embodiment said group or groups can be arranged in columns of second antenna elements as conductive parts on a top layer of a substrate such as a Printed Circuit Board (PCB). The PCB with the dipoles in each column coupled in series then constitutes the second antenna aperture. The PCB can be of a rigid or flexible type. For clarity reasons only the dipoles and feeding lines to the dipoles are shown of the second antenna aperture. The underlying first antenna aperture 101 and the vertical slots 102 of the first antenna aperture are shown with dotted lines. The PCB is thus covering the first antenna aperture 101. The dipoles are arranged in substantially parallel columns 202 of second antenna elements and each column of the second antenna elements is placed substantially in parallel with the columns 105 of the first antenna elements. Typically the dipoles are located in between the columns of first antenna elements. For the same reason as explained for the first antenna aperture the distance between neighboring columns of the second antenna elements should be substantially constant and typically around half a wavelength or less of a centre frequency in the frequency band of the second antenna aperture for the antenna structure to be electronically scannable. This distance is defined as a third distance 203. This also means that the third distance 203 can be somewhat above half a wavelength depending on the antenna scan requirements. In this example the third distance 203 is about 3-4 times longer than the first distance 107 corresponding to the difference in wavelength between the first and second antenna apertures. In this example the column 202 of the second antenna elements is inserted after the first column 105 of the first antenna elements (when the slot columns are numbered from left to right) and then after every third column of first antenna elements. For a non-scannable antenna structure the third distance can be above half a wavelength, typically around one wavelength. There is also a substantially constant fourth distance 204 between neighboring dipoles in a column of second antenna elements. The length and width of a dipole can vary slightly from dipole to dipole in order to achieve the tapering effect as mentioned in association with FIG. 1. The fourth distance 204 can be slightly varied in order to change the phase to each dipole and thus the shape and direction of the lobe in elevation.

The second antenna aperture is in one example of the invention typically located in front of the first antenna aperture at a distance in the order of a wavelength of the centre frequency of the frequency band of the first antenna aperture.

The second antenna aperture has a third edge 209 and a fourth edge 210, the edges being part of the perimeter of the second antenna aperture. The third edge is limiting the longitudinal extension of the column 202 of the second antenna elements in one direction and the fourth edge is limiting the longitudinal extension of the column 202 of the second antenna elements in the opposite direction. The shape of the second antenna aperture is rectangular in the example of FIG. 2, but any other shapes are possible within the scope of the invention. The shape can e.g. be adapted to fit a shape of a radome covering the second antenna aperture.

All dipoles in one column 202 of the second antenna elements are fed indirectly through one straight microstrip line 206. Each microstrip line has a common feeding point 205 for all dipoles in a column. The common feeding point is located at the third or fourth edge. Each group of second antenna elements, in this example dipoles in columns, thus have a common feeding point on a straight microstrip line, one microstrip line being located adjacent to each group of second antenna elements. The microstrip line can be implemented in further layers of the PCB or some other type of non-conductive substrate as will be shown in detail in FIGS. 3 and 4.

Each column 202 of second antenna elements can thus be fed from one of the edges of the radar antenna structure, and no feed-through holes are therefore necessary. The number of dipoles in each column must be limited to fulfill the bandwidth requirement. The bandwidth will decrease with the number of antenna elements. Typically it will be possible to cover the IFF/SSR bandwidth with 5-6 antenna elements. Furthermore, the dipoles and feeding line must be designed to be as transparent as possible to the primary radar function as described.

The dipoles are preferably proximity coupled dipoles, fed from a straight microstrip line with small "gaps" below the dipoles, see FIGS. 3*a* and 3*b*. The dipoles can also be galvanically coupled to the microstrip line as illustrated in FIG. 3*c*.

The feeding structure can thus e.g. be a microstrip line or other suitable feeding structure and is henceforth exemplified with a microstrip line.

Figure 3A:
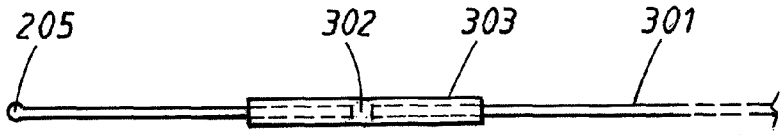
FIG. 3*a* schematically shows a top view of one example of the feeding arrangement to the dipoles according to the invention.

FIG. 3*a* shows a top view of an example of an elongated straight microstrip line 301 applied to some type of substrate as a Printed Circuit Board (PCB) or a Flexible Printed Circuit Board (FPCB) or other non conductive laminate. The microstrip line has a gap 302 and a second antenna element, comprising in this example a dipole element 303, located above the gap with a mid point of the dipole element centred above the gap. The microstrip line has the common RF-feeding point 205 at one endpoint of the line and the microstrip line can have several gaps with one dipole elements centered above each gap. The mid point of the dipole is located essentially in the middle of the longitudinal extension of the dipole element. In other examples of the invention, as will be further described below, the mid point of the dipole does not have to be centred above the gap as long as a part of the dipole has a vertical projection towards the gap covering at least a part of the gap.

Figure 3B:
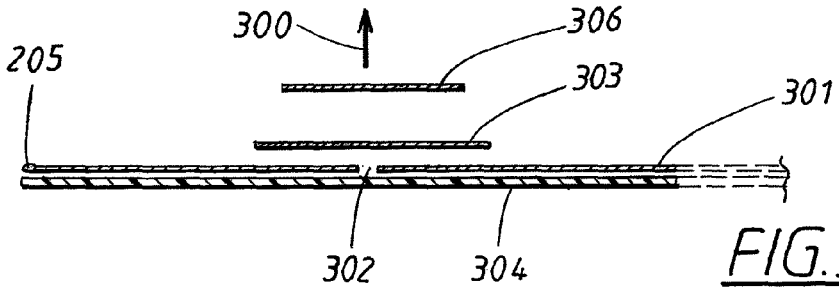
FIG. 3*b* schematically shows a side view of one example of the feeding arrangement to the dipoles according to the invention.
Figure 3C:
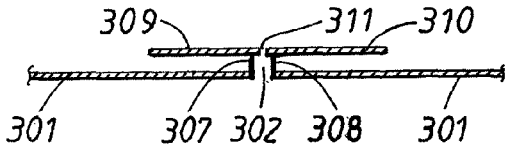
FIG. 3*c* schematically shows a side view of a galvanic coupling to the second antenna elements.
Figure 4:
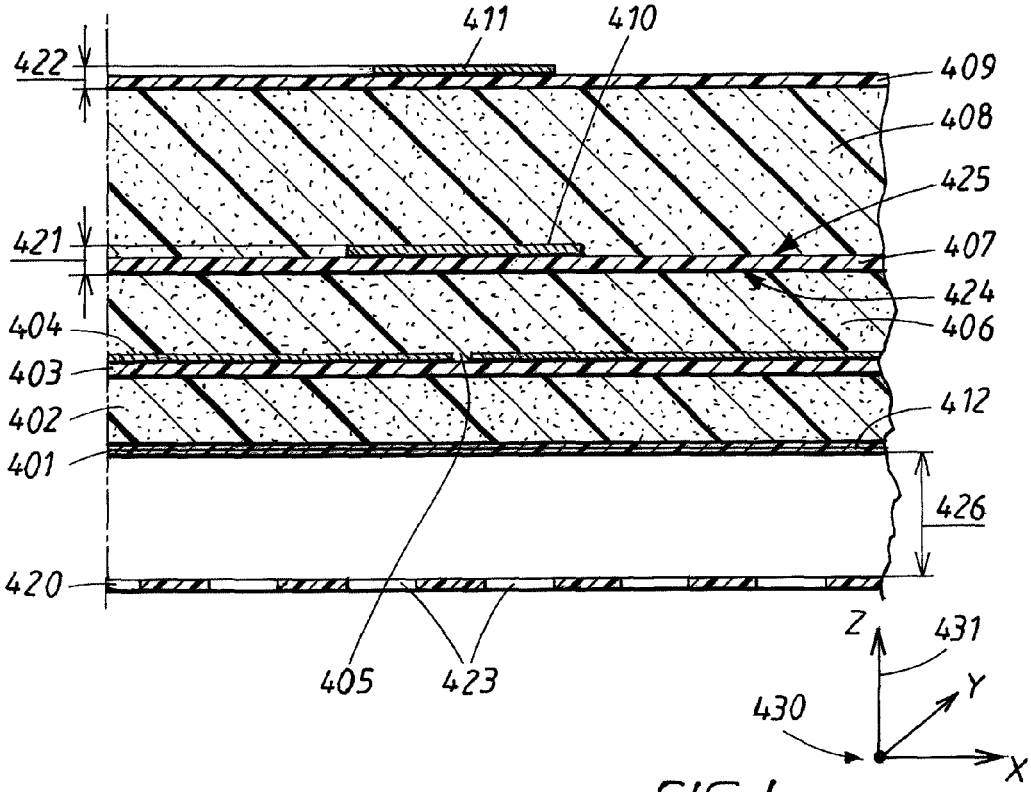
FIG. 4 schematically shows an example of an antenna structure according to the invention.

FIG. 3*b* shows a side view of the microstrip line 301 with the gap 302, the dipole element 303 and the common RF-feeding point 205. The elongated microstrip line 301 is applied to a non conductive laminate located between the first and second antenna apertures. Arrow 300 shows the mean boresight beam direction in transmit mode for the configuration of FIG. 3. The microstrip line has one gap 302 for each antenna element in the second antenna aperture with a vertical projection of the second antenna element towards the microstrip line covering at least part of the gap and the microstrip line has the common RF-feeding point 205 located at one endpoint of the microstrip line. FIG. 3*b* also shows a ground plane 304 located on a side of the microstrip line facing away from the dipole element 303. The ground plane 304 of the microstrip line can be either the surface of the slot antenna (between the slots) or a conductive structure such as a number of conductive wires or other conductive elements being substantially parallel to the extension of the first and second antenna elements, in this example the dipoles and slots, and being printed on a substrate, the substrate being located some distance in front of the first aperture. The conductive structure can also be integrated in the substrate as illustrated in FIG. 4. This distance is not critical, typically a distance of a half to one wavelength of a mean operating frequency of the first antenna aperture is used. However the distance between the conductive structure, forming the ground plane, and the first antenna aperture can be adapted to the actual application. This gives an additional freedom to locate the second antenna elements, in this example dipole antennas, into the radome. A first parasitic dipole element 306 above or in front of the first dipole element 303 can optionally be used to increase the bandwidth or to make the second antenna aperture dual resonant by working in two frequency bands. Further parasitic dipole elements can optionally be stacked above or in front of the first parasitic dipole elements. The antenna structure can thus have at least a high and a low frequency band. The first parasitic dipole element is fed non-galvanically from the dipole element and the optionally further parasitic dipole elements are fed from adjacent parasitic dipole element. As explained in association with FIG. 3*a* the microstrip line can have several gaps each with associated dipole elements and the optionally parasitic element or elements. An advantage with the invention is that the direction of the microstrip lines are, in the example of FIG. 2, aligned substantially in parallel with the slots of the first aperture, but most important substantially perpendicular to the polarization of the first antenna elements. The general feature for all applications of the invention is that the direction of the feeding structure should be substantially perpendicular to the polarization of the first antenna elements. This feature minimizes the disturbances of the feeding arrangement to the radiations from the first and second aperture since the elongation of the feed structure, in the direction of the first antenna polarization direction, is much smaller than the wavelength used for the first antenna.

The straight microstrip line is thus located adjacent to the second antenna elements, the direction of the microstrip line being substantially perpendicular to the polarization of the radiation pattern of the first antenna elements.

For clarity reasons, FIG. 3 only shows the conductive parts of the antenna structure.

FIG. 3*c* shows an example of a galvanic coupling between the microstrip line and the second antenna elements as an alternative to proximity coupling described in association with FIGS. 3*a* and 3*b*. In FIG. 3*c*, a first conductive element 307 connects between the microstrip line 301 and a first part 309 of the dipole element and a second conductive element 308 connects between the microstrip line 301 and a second part 310 of the dipole element. The first and second parts of the dipole elements are separated by a dipole gap 311. The first and second conductive elements contact the microstrip line on different sides of the gap 302. The dipole element is here a realization of the second antenna element.

The invention thus provides an antenna structure comprising at least two stacked antenna apertures, the first antenna aperture with first antenna elements and at least a second antenna aperture with second antenna elements. The antenna structure is arranged for operation in at least a high and a low frequency band. The first antenna elements are arranged for operation in the high frequency band and said second antenna elements for operation in the low frequency band. The first antenna elements are arranged to have a polarization substantially perpendicular to the polarization of the second antenna elements. The second antenna elements are arranged in at least one group and each of said group, comprises a number of second antenna elements coupled in series and arranged to have a common feeding point on a straight feeding structure. One feeding structure is located adjacent to each group of second antenna elements. The direction of the feeding structure is substantially perpendicular to the polarization of the first antenna elements.

FIG. 4 schematically shows a side view of one embodiment of the invention with the first antenna aperture 420, the second antenna aperture 421 and a third antenna aperture 422. The first antenna aperture is a conductive surface comprising the first antenna elements in this example realized as slots 423. The ground plane 304, in this embodiment realized as conductive wires 412 integrated into, or plated on a surface of, a first laminate 401 which is located substantially in parallel with the first antenna aperture 420 at a distance 426. The conductive wires 412 have a longitudinal extension substantially in parallel with the second antenna elements, in this case the dipole elements. This distance is typically, as mentioned above, in the order of a half to one wavelength of the frequency of the antenna elements in the first antenna aperture. The microstrip line 404 with its gaps 405 is applied to a second laminate 403. A first foam structure 402 is located between the first and the second laminate. The second antenna elements 410, in this example the dipole elements, are applied to a third laminate 407 and the optional first parasitic antenna elements 411, in this case dipole elements, are applied to a fourth laminate 409. The second antenna aperture 421, comprising the third laminate 407 and the second antenna elements 410, has a first side 424 facing a second foam structure 406 and the microstrip line 404 and a second side 425 facing a third foam structure 408 and the third antenna aperture 422. The second foam structure 406 is located between the second and third laminate and the third foam structure 408 is located between the third and the fourth laminate. In this embodiments the laminates, foam structures, antenna elements and microstrip lines are realized as flat structures each located in a separate x/y plane, see coordinate symbol 430. Also curved structures can be used as will be shown in FIG. 5. A suitable foam structure with a relative dielectric constant close to 1 ($\in_r \approx 1$) is available under trade name Rohacell. The mean boresight beam direction in transmit mode in this example is in the positive z-direction, 431.

The second antenna aperture 421 comprises in this embodiment of:

the third laminate 407 and the second antenna elements 410.

The third antenna aperture 422 comprises of:

the fourth laminate 409 and the first parasitic antenna elements 411.

By separating the first and second antenna apertures by the distance 426 and the thicknesses of the first 402 and the second 406 foam structure and the first 401 and second 403 laminate, over and above having orthogonal polarizations between the antenna elements of the first and second antenna aperture, the disturbances between the two antenna apertures will be minimized which is an advantage of the invention. The separation by the distance 426 can be accomplished by conventional mechanical means or a further foam structure can be inserted between the first antenna aperture 420 and the first laminate 401 with the conductive wires 412 forming the ground plane.

In further embodiments, one or several of the foam structures can be deleted and substituted by the thickness of the laminates themselves. As an alternative, other types of structures as e.g. honeycomb can be used. It is also possible to replace the foam structure with air and a mechanical arrangement for separating the laminates. The laminates are typically some type of rigid or flexible PCB, but can be any type of non-conductive holder for the conductive elements as the antenna elements, ground plane or microstrip line.

Another advantageous embodiment of the invention is to incorporate the second antenna aperture with the feeding structure and the ground plane and optionally the third antenna aperture in a radome to the antenna structure. The foam structures described above can then in one embodiment be replaced with the material of the radome. The radome can however be manufactured in many ways. One possibility is to make it solid with the second and third antenna apertures integrated as described above and with a thickness approximately equal to or much less than half a wavelength of a centre frequency of the first antenna aperture frequency band. Another way to realize the radome is to build it like a sandwich-structure with two or more hard layers comprising PCBs with antenna elements and optionally also feeding structure and ground plane. A foam or honeycomb material is then inserted between the hard layers. The radome is then mounted above or in front of the first antenna aperture at a suitable distance. The radome will have plastics removed from certain areas to allow contacting to the common RF-feeding point of the second antenna elements and to the ground plane.

Figure 5:
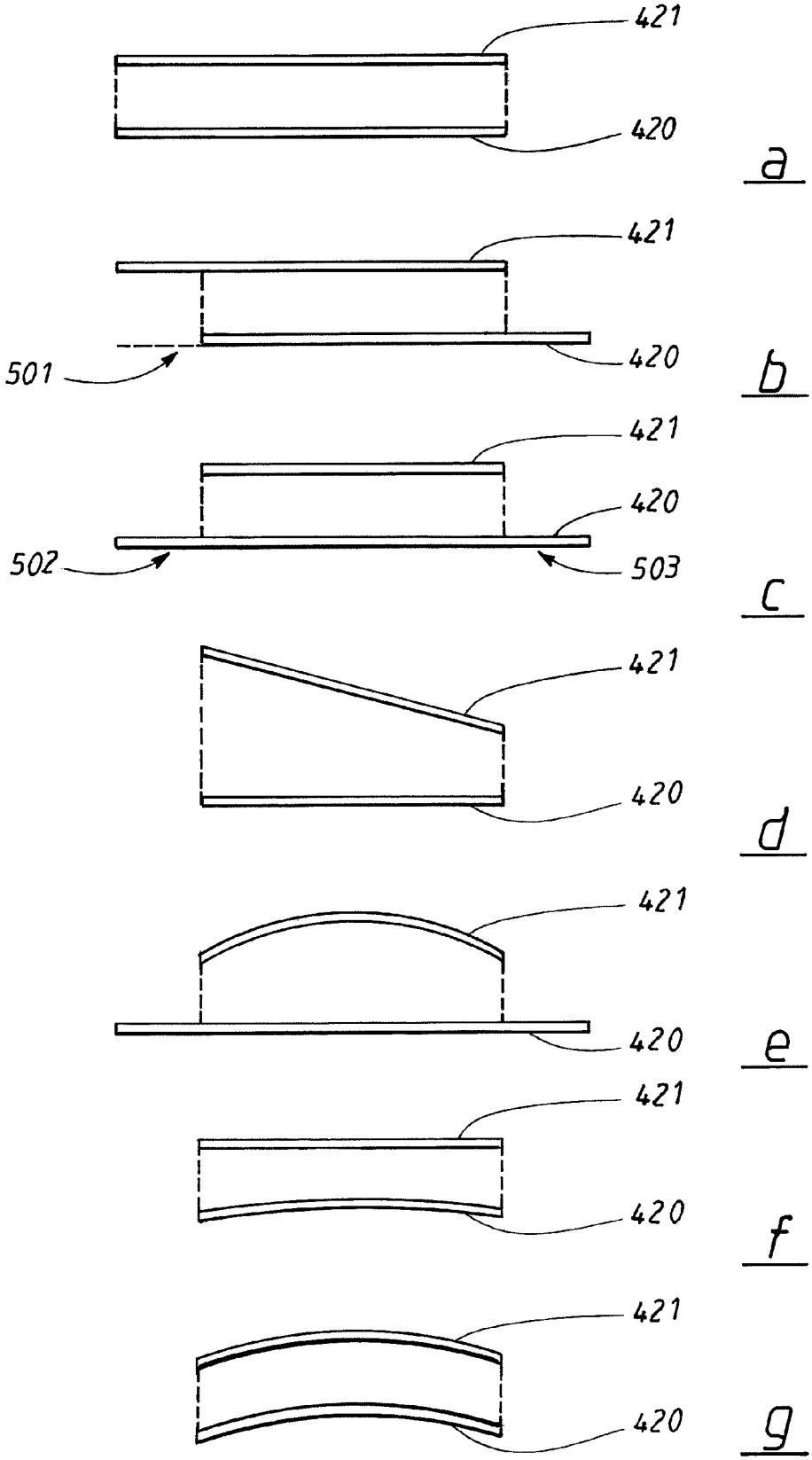
FIG. 5 schematically shows examples of different configurations of antenna apertures.

The antenna apertures can be flat, extend in an x/y-plane and be substantially parallel to each other as explained in association with FIG. 4. However the antenna apertures can also be curved in a third dimension and the apertures do not necessarily have to be in parallel. FIG. 5 shows some possible configuration when there are two apertures. FIG. 5*a* shows the stacked, first and second antenna apertures 420 and 421, the antenna apertures being in parallel, with the vertical projection of the second aperture 421 completely covering the area of the first aperture 420. FIG. 5*b* shows an example where the apertures are in parallel, with the vertical projection of the second aperture covering a main part of the area of the first aperture and an area 501 outside the area of the first aperture. FIG. 5*c* is a variation of FIG. 5*b* where the vertical projection of the second aperture is covering a main part of the first aperture except for certain first 502 and second 503 side areas. FIG. 5*d* illustrates two flat apertures not being in parallel, with the vertical projection of the second aperture covering the complete area of the first aperture. FIGS. 5*e*-5*g* shows three examples of curved apertures where the vertical projection of the second aperture covers a main area of the first aperture. FIG. 5*e* showing curved second aperture and flat first aperture, FIG. 5*f* showing flat second aperture and curved first aperture and finally FIG. 5*g* showing both apertures curved. Combinations of the examples are also possible as e.g. the example of FIGS. 5*e* and 5*b* where a part of the vertical projection of the second aperture falls outside the area of the first aperture. In the embodiment with the second aperture incorporated in the radome the configuration of FIG. 5*e* can be suitable to allow the second aperture to conform to a certain desirable outer shape of the antenna structure.

A further example of an embodiment of the invention is that the second antenna elements are applied to a first layer of a Flexible PCB (FPCB) or PCB including the microstrip line in a second intermediate layer. The FPCB or PCB which can be very thin, typically around 1-3 mm, is then applied directly to the first antenna aperture using the conductive parts between the slots of the first antenna aperture as the ground plane 304. The two antenna apertures will then be applied in substantially the same plane.

The invention makes it possible to use substantially the same geometrical area for two antenna functions, different in frequency and polarization. For the application described above, it is important to use as large aperture as possible for the IFF/SSR-antenna in order to give good angular accuracy and to obtain high gain.

The second antenna elements are fed from the third (209) or fourth (210) edge of the second antenna aperture. This means that no feed-through holes are required, which is an additional advantage of the invention.

The invention has been exemplified with different embodiments and examples on how to build the antenna structure and how to realize the different elements such as the antenna elements, laminates, foam structures, ground plane and microstrip lines being a part of the antenna structure. The invention is however not limited to these embodiments and examples but can be realized in any convenient way within the scope of the invention. As an example the microstrip lines and the second antenna elements can be realized as metal sheets glued to e.g. a Rohacell foam structure.

The invention is not limited to the embodiments above, but may vary freely within the scope of the appended claims.

The invention claimed is:

1. An antenna structure, comprising:

at least two stacked antenna apertures, a first antenna aperture with first antenna elements and at least a second antenna aperture with second antenna elements, wherein antenna structure is arranged for operation in at least a high and a low frequency band with the first antenna elements being arranged for operation in the high frequency band and said second antenna elements for operation in the low frequency band, the first antenna elements being arranged to have a polarization substantially perpendicular to the polarization of the second antenna elements, and wherein the second antenna elements are arranged in at least one group and each of said group, comprising a number of second antenna elements coupled in series, are arranged to have a common feeding point on a straight feeding structure, one feeding structure being located adjacent to each group of second antenna elements, the direction of the feeding structure being substantially perpendicular to the polarization of the first antenna elements.

2. The antenna structure according to claim 1, wherein the second antenna elements are dipoles, and wherein each of said group is arranged in a column of second antenna elements, the columns being substantially in parallel.

3. The antenna structure according to claim 1, wherein the first antenna elements are slots in parallel waveguides, the waveguides being parallel to the columns of the second antenna elements and the slots being arranged in a lattice.

4. The antenna structure according to claim 1, wherein the columns of the second antenna elements are arranged in between the columns of the first antenna elements.

5. The antenna structure according to claim 1, wherein the second antenna aperture is located above or in front of the first antenna aperture and having a vertical projection towards the first antenna aperture being mainly within the area of the first antenna aperture.

6. The antenna structure according to claim 1, wherein first parasitic dipole elements on a third antenna aperture are located above or in front of a second side of the second antenna aperture.

7. The antenna structure according to claim 1, wherein the columns of the first antenna elements are arranged along a center line of each waveguide, every second slot being off-centred to one side of the center line (106) and the slots in between being off-centered to the opposite side of the center line, and wherein there is a substantially constant first distance between the center lines of adjacent waveguides and a substantially constant second distance between neighbouring slots in the column of the first antenna elements.

8. The antenna structure according to claim 1, wherein the columns of the second antenna elements are placed between and in parallel with two columns of the first antenna elements, the parallel displacement being about half of the first distance, a third distance between neighboring columns of the second antenna elements and a fourth distance between neighboring second antenna elements in a column of the second antenna elements being substantially constant.

9. The antenna structure according to claim 1, wherein the ground plane of the feeding structure comprises a conductive structure located some distance above or in front of the first antenna aperture.

10. The antenna structure according to claim 1, wherein:

the first antenna aperture is a conductive surface comprising the first antenna elements, the ground plane comprising a conductive structure is integrated into a first laminate and located substantially in parallel with the first antenna aperture at a distance, the feeding structure with its gaps is applied to a second laminate, the second antenna elements are applied to a third laminate, and the optional first parasitic antenna elements are applied to a fourth laminate.

11. The antenna structure according to claim 10, wherein:

a first foam structure is located between the first and second laminate, and a second foam structure is located between the second and third laminate and a third foam structure is located between the third and fourth laminate.

12. The antenna structure according to claim 10, wherein the ground plane, the feeding structure, the first foam structure, the optional first parasitic antenna element and the second foam structure are integrated in a radome covering the first antenna aperture.

13. The antenna structure according to claim 1, wherein the second antenna aperture and the feeding structure with its ground plane is integrated in a radome covering the first antenna aperture.

14. The antenna structure according to claim 1, wherein the ground plane of the feeding structure comprises the conductive surface of the first antenna aperture.

15. The antenna structure according to claim 1, wherein the antenna apertures are plane or curved in a third dimension.

16. The antenna structure according to claim 1, wherein the elongated feeding structure is applied to a non conductive second laminate located between the first and second antenna apertures, the feeding structure having one gap for each second antenna element with a vertical projection of the second antenna element towards the feeding structure covering at least part of the gap and further in that the feeding structure has the common RF-feeding point located at one endpoint of the feeding structure.

17. The antenna structure according to claim 16, wherein the second antenna elements are dipoles, and wherein a midpoint of the dipole is centred above the gap.

18. The antenna structure according to claim 1, wherein the first distance is about a half wavelength or less of a center frequency in the frequency band of the first antenna aperture, and wherein the third distance is about a half wavelength or less of a center frequency in the frequency band of the second antenna aperture for the antenna structure to be electronically scannable.

19. The antenna structure according to claim 1, wherein the amount of off-centering of the slots and the length of the slots can be slightly varied from slot to slot to achieve a tapering effect.

20. The antenna structure according to claim 1, wherein the length and width of a dipole can vary slightly from dipole to dipole in order to achieve a tapering effect.

21. The antenna structure according to claim 1, wherein further parasitic dipole elements are stacked above or in front of the first parasitic dipole elements.

22. The antenna structure according to claim 1, wherein the second antenna elements are proximity coupled or galvanically coupled to the feeding structure.

23. The antenna structure according to claim 1, wherein the first and second antenna elements can be electronically scanned.

24. A radar system, comprising:

an antenna structure comprising at least two stacked antenna apertures, a first antenna aperture with first antenna elements and at least a second antenna aperture with second antenna elements, wherein antenna structure is arranged for operation in at least a high and a low frequency band with the first antenna elements being arranged for operation in the high frequency band and said second antenna elements for operation in the low frequency band, the first antenna elements being arranged to have a polarization substantially perpendicular to the polarization of the second antenna elements, and wherein the second antenna elements are arranged in at least one group and each of said group, comprising a number of second antenna elements coupled in series, are arranged to have a common feeding point on a straight feeding structure, one feeding structure being located adjacent to each group of second antenna elements, the direction of the feeding structure being substantially perpendicular to the polarization of the first antenna elements.

25. A method for arranging an antenna structure comprising at least two stacked antenna apertures, a first antenna aperture with first antenna elements and at least a second antenna aperture with second antenna elements, the method comprising:

arranging the antenna structure for operation in at least a high and a low frequency band, arranging the first antenna elements for operation in the high frequency band and said second antenna elements for operation in the low frequency band, wherein the first antenna elements have a polarization substantially perpendicular to the polarization of the second antenna elements, and arranging the second antenna elements in at least one group and each of said group, comprising a number of second antenna elements coupled in series, having a common feeding point on a straight feeding structure, one feeding structure being located adjacent to each group of second antenna elements, the direction of the feeding structure being substantially perpendicular to the polarization of the first antenna elements.

* * * * *